US007140110B2

(12) United States Patent
Lake

(10) Patent No.: US 7,140,110 B2
(45) Date of Patent: Nov. 28, 2006

(54) FOLDING KNIFE HAVING A LOCKING MECHANISM

(76) Inventor: Ronald W. Lake, 3360 Bendix Ave., Eugene, OR (US) 97401

( * ) Notice: Subject to any disclaimer, the term of this patent is extended or adjusted under 35 U.S.C. 154(b) by 113 days.

(21) Appl. No.: 10/861,890

(22) Filed: Jun. 4, 2004

(65) Prior Publication Data

US 2005/0241154 A1 Nov. 3, 2005

Related U.S. Application Data

(60) Provisional application No. 60/475,480, filed on Jun. 4, 2003.

(51) Int. Cl.
*B26B 3/06* (2006.01)

(52) U.S. Cl. ..... 30/160; 30/161

(58) Field of Classification Search ..... 30/155–162
See application file for complete search history.

(56) References Cited

U.S. PATENT DOCUMENTS

| | | | | |
|---|---|---|---|---|
| 23,975 | A | 9/1859 | Belcher | |
| 57,902 | A | 9/1866 | Hibbard | |
| 226,910 | A | 4/1880 | Friebertshauser | |
| 338,251 | A | 3/1886 | Crandall et al. | |
| 382,967 | A | 5/1888 | Fullerton | |
| 530,792 | A | 12/1894 | Nordlow | |
| 551,052 | A | 12/1895 | Waldron et al. | |
| 552,928 | A | 1/1896 | Russell | |
| 557,760 | A | 4/1896 | Brauer | |
| 577,593 | A | 2/1897 | Bronson et al. | |
| 600,442 | A | 3/1898 | Nell | |
| 616,689 | A | 12/1898 | Ruettgers | |
| 749,330 | A | 1/1904 | Severance | |
| 777,358 | A | 12/1904 | Weck | |
| 868,179 | A * | 10/1907 | Griswold | 30/161 |
| 1,189,005 | A | 6/1916 | Seely | |
| 1,315,503 | A | 9/1919 | Hughes | |
| 1,319,532 | A | 10/1919 | Ramussen | |
| 1,357,398 | A | 11/1920 | Haywood | |
| 1,412,373 | A | 4/1922 | Shields | |
| 1,440,793 | A | 1/1923 | Rasmussen | |

(Continued)

FOREIGN PATENT DOCUMENTS

| | | |
|---|---|---|
| DE | 1 104 386 | 4/1961 |

(Continued)

*Primary Examiner*—Timothy V. Eley
*Assistant Examiner*—Isaac N Hamilton
(74) *Attorney, Agent, or Firm*—Teri Andrews

(57) ABSTRACT

A folding knife is disclosed. The knife includes a handle; a blade having a tang pivotably connected to the handle allowing pivoting of the blade between a closed position in which the blade extends along the handle, and an open position in which the blade extends away from the handle; a locking element pivotably connected to the handle, wherein the locking element is configured to be pivotable between a first position in which the locking element engages at least part of the tang in a manner preventing pivoting of the blade from the open position to the closed position, and a second position in which the blade is free to pivot from the open position to the closed position; a bias element configured to urge the locking element towards the first position; and a safety assembly mounted for sliding movement along the handle, wherein the safety assembly is movable between a safety position in which the safety assembly engages part of the locking element in a manner preventing pivoting of the locking element relative to the handle, and a release position in which the locking element is free to pivot relative to the handle.

41 Claims, 3 Drawing Sheets

U.S. PATENT DOCUMENTS

| | | | | | |
|---|---|---|---|---|---|
| 1,454,665 | A | | 5/1923 | Bobek | |
| 1,515,688 | A | | 11/1924 | Love | |
| 1,584,165 | A | | 5/1926 | Brown | |
| 1,603,914 | A | | 10/1926 | Hermann | |
| 1,614,949 | A | | 1/1927 | Finley | |
| 1,701,027 | A | | 2/1929 | Brown | |
| 1,743,022 | A | | 1/1930 | Carman | |
| 1,810,031 | A | | 6/1931 | Schrade | |
| 1,864,011 | A | | 6/1932 | Brown | |
| 2,286,524 | A | | 6/1942 | Wilbur | 30/161 |
| 2,304,601 | A | | 12/1942 | Schrade | 30/159 |
| 2,407,897 | A | | 9/1946 | Newman | 30/159 |
| 2,569,080 | A | | 9/1951 | Trimble et al. | 30/320 |
| 2,596,294 | A | | 5/1952 | Schrade | 30/161 |
| 2,736,959 | A | | 3/1956 | Simon et al. | 30/123 |
| 2,808,646 | A | * | 10/1957 | Junior et al. | 30/159 |
| 3,079,784 | A | | 3/1963 | Pavioski | 70/456 |
| 3,404,456 | A | | 10/1968 | Chilko | 30/155 |
| 3,868,774 | A | | 3/1975 | Miori | 30/161 |
| 3,896,546 | A | | 7/1975 | Hildebrandt | 30/157 |
| 4,040,181 | A | | 8/1977 | Johnson | 30/161 |
| 4,122,569 | A | | 10/1978 | Hitchcock | 7/134 |
| 4,124,939 | A | * | 11/1978 | Onoue | 30/161 |
| 4,133,106 | A | | 1/1979 | Addis | 30/160 |
| 4,148,140 | A | | 4/1979 | Lile | 30/161 |
| 4,203,213 | A | | 5/1980 | Mollica | |
| 4,218,819 | A | | 8/1980 | Phelps | |
| 4,238,862 | A | | 12/1980 | Leatherman | |
| 4,268,960 | A | | 5/1981 | Reinschreiber | |
| 4,274,200 | A | | 6/1981 | Coder | |
| 4,297,756 | A | | 11/1981 | Lance | |
| 4,322,885 | A | | 4/1982 | Osada | |
| 4,347,665 | A | | 9/1982 | Glesser | |
| 4,356,631 | A | | 11/1982 | Guth | |
| 4,404,748 | A | | 9/1983 | Wiethoff | |
| 4,408,394 | A | | 10/1983 | Phelps | |
| 4,439,922 | A | | 4/1984 | Sassano | |
| 4,451,982 | A | | 6/1984 | Collins | |
| 4,466,561 | A | | 8/1984 | Slaughter | |
| 4,502,221 | A | | 3/1985 | Pittman | |
| 4,512,051 | A | | 4/1985 | Magan | |
| 4,541,175 | A | | 9/1985 | Boyd et al. | |
| 4,563,813 | A | * | 1/1986 | Fortenberry | 30/161 |
| 4,570,341 | A | | 2/1986 | Konneker | |
| 4,604,803 | A | | 8/1986 | Sawby | 30/161 |
| 4,612,706 | A | | 9/1986 | Yunes | 30/160 |
| 4,670,984 | A | | 6/1987 | Rickard | 30/161 |
| 4,719,700 | A | | 1/1988 | Taylor, Jr. | 30/158 |
| 4,741,106 | A | | 5/1988 | Yamagishi | 30/161 |
| 4,776,094 | A | | 10/1988 | Glesser | 30/160 |
| 4,802,279 | A | | 2/1989 | Rowe | 30/155 |
| 4,811,486 | A | | 3/1989 | Cunningham | 30/161 |
| 4,811,642 | A | | 3/1989 | Sorbi | 83/574 |
| 4,837,932 | A | | 6/1989 | Elsener | 30/161 |
| 4,856,132 | A | | 8/1989 | Burns et al. | 7/118 |
| 4,893,409 | A | | 1/1990 | Poehlmann | 30/161 |
| 4,896,424 | A | | 1/1990 | Walker | 30/349 |
| 4,947,552 | A | | 8/1990 | Barnes | 30/161 |
| 4,955,139 | A | | 9/1990 | Clotten et al. | 30/340 |
| 4,974,323 | A | | 12/1990 | Cassady | 30/155 |
| 4,979,301 | A | | 12/1990 | Walker | 30/161 |
| 5,029,355 | A | | 7/1991 | Thai | 7/118 |
| 5,060,379 | A | | 10/1991 | Neely | 30/161 |
| 5,062,173 | A | | 11/1991 | Collins et al. | 7/118 |
| 5,092,045 | A | | 3/1992 | Boyd, Jr. et al. | 30/161 |
| 5,095,624 | A | | 3/1992 | Ennis | 30/161 |
| 5,111,581 | A | | 5/1992 | Collins | 30/161 |
| 5,122,844 | A | | 6/1992 | Akiba et al. | 357/17 |
| 5,131,149 | A | | 7/1992 | Thompson et al. | 30/161 |
| D336,602 | S | | 6/1993 | Thompson et al. | D8/99 |
| D338,386 | S | | 8/1993 | Frazer | D8/105 |
| 5,293,690 | A | | 3/1994 | Cassady | 30/161 |
| D345,688 | S | | 4/1994 | McLean et al. | D8/356 |
| D348,599 | S | | 7/1994 | Sakai | D8/99 |
| 5,325,588 | A | | 7/1994 | Rogers | 30/161 |
| 5,329,675 | A | | 7/1994 | McLean et al. | 24/599 |
| 5,331,741 | A | | 7/1994 | Taylor, Jr. | 30/158 |
| 5,349,753 | A | | 9/1994 | Gaffney | 30/155 |
| 5,400,509 | A | | 3/1995 | Collins | 30/161 |
| 5,425,175 | A | | 6/1995 | Rogers | 30/161 |
| 5,437,101 | A | | 8/1995 | Collins | 30/153 |
| 5,461,786 | A | | 10/1995 | Miller | 30/161 |
| 5,463,798 | A | | 11/1995 | Wurzer | 24/599.5 |
| D365,266 | S | | 12/1995 | Hasegawa | D8/99 |
| 5,493,781 | A | | 2/1996 | Saito | 30/162 |
| D367,807 | S | | 3/1996 | Hung | D8/105 |
| 5,497,522 | A | | 3/1996 | Chen | 7/128 |
| 5,502,895 | A | | 4/1996 | Lemaire | 30/158 |
| 5,511,310 | A | | 4/1996 | Sessions et al. | 30/161 |
| 5,515,610 | A | | 5/1996 | Levin et al. | 30/161 |
| 5,553,340 | A | | 9/1996 | Brown, Jr. | 7/118 |
| 5,581,834 | A | | 12/1996 | Collins | 7/118 |
| 5,581,895 | A | | 12/1996 | Jeffcoat | 30/294 |
| D377,744 | S | | 2/1997 | Hasegawa | D8/99 |
| D378,982 | S | | 4/1997 | Thompson | D8/99 |
| 5,615,484 | A | | 4/1997 | Pittman | 30/161 |
| 5,628,117 | A | | 5/1997 | Glesser | 30/298.4 |
| 5,647,129 | A | | 7/1997 | Stamper | 30/139 |
| D384,871 | S | | 10/1997 | McWillis | D8/99 |
| 5,685,079 | A | | 11/1997 | Brothers et al. | 30/161 |
| 5,692,304 | A | | 12/1997 | Campbell | 30/161 |
| 5,697,114 | A | | 12/1997 | McIntosh et al. | 7/129 |
| 5,699,615 | A | | 12/1997 | Chen | 30/160 |
| D389,718 | S | | 1/1998 | Wegner | D8/99 |
| D392,539 | S | | 3/1998 | Balolia | D8/99 |
| 5,737,841 | A | | 4/1998 | McHenry et al. | 30/161 |
| 5,755,035 | A | | 5/1998 | Weatherly | 30/161 |
| 5,781,998 | A | | 7/1998 | Stamper | 30/139 |
| 5,802,722 | A | | 9/1998 | Maxey et al. | 30/160 |
| D399,113 | S | | 10/1998 | Balolia | D8/99 |
| 5,815,927 | A | | 10/1998 | Collins | 30/161 |
| 5,819,414 | A | | 10/1998 | Marifone | 30/160 |
| 5,822,866 | A | | 10/1998 | Pardue | 30/161 |
| 5,822,867 | A | | 10/1998 | Sakai | 30/298.4 |
| 5,826,340 | A | | 10/1998 | Hull | 30/161 |
| 5,839,194 | A | | 11/1998 | Bezold | 30/161 |
| D402,178 | S | | 12/1998 | Glesser | D8/99 |
| 5,845,404 | A | | 12/1998 | Jeffcoat | 30/125 |
| 5,875,552 | A | | 3/1999 | Chen | 30/161 |
| D407,961 | S | | 4/1999 | Balolia | D8/99 |
| 5,964,036 | A | | 10/1999 | Centofante | 30/161 |
| 5,966,816 | A | | 10/1999 | Roberson | 30/156 |
| 5,979,065 | A | | 11/1999 | Hsu | 30/519 |
| 6,079,106 | A | | 6/2000 | Vallotton | 30/161 |
| 6,101,723 | A | | 8/2000 | Ford | 30/157 |
| 6,122,829 | A | | 9/2000 | McHenry et al. | 30/161 |
| 6,125,543 | A | | 10/2000 | Jhones | 30/161 |
| 6,134,788 | A | | 10/2000 | Chen et al. | 30/125 |
| 6,145,202 | A | | 11/2000 | Onion | 30/160 |
| D434,631 | S | | 12/2000 | Lum | D8/99 |
| D434,632 | S | | 12/2000 | Tseng | D8/105 |
| 6,154,965 | A | | 12/2000 | Sakai | 30/161 |
| 6,158,127 | A | | 12/2000 | Taylor | 30/158 |
| 6,233,769 | B1 | | 5/2001 | Seber et al. | 7/128 |
| D444,685 | S | | 7/2001 | Shenkel et al. | D8/18 |
| 6,256,888 | B1 | | 7/2001 | Shuen | 30/161 |
| 6,276,063 | B1 | | 8/2001 | Chen | 30/161 |
| 6,289,592 | B1 | | 9/2001 | Emerson | 30/161 |
| 6,308,420 | B1 | | 10/2001 | Moser | 30/161 |
| 6,338,431 | B1 | | 1/2002 | Onion | 230/161 |
| 6,345,202 | B1 | | 2/2002 | Richmond et al. | 607/42 |
| 6,363,615 | B1 | | 4/2002 | Moser | 30/161 |
| 6,378,214 | B1 | | 4/2002 | Onion | 30/161 |
| 6,397,476 | B1 | | 6/2002 | Onion | 30/160 |

| | | | | |
|---|---|---|---|---|
| 6,397,477 | B1 | 6/2002 | Collins | 30/161 |
| 6,427,334 | B1 | 8/2002 | Onion | 30/161 |
| 6,427,335 | B1 | 8/2002 | Ralph | 30/161 |
| 6,430,816 | B1 | 8/2002 | Neveux | 30/161 |
| 6,434,831 | B1 | 8/2002 | Chen | 30/161 |
| 6,438,848 | B1 | 8/2002 | McHenry et al. | 30/161 |
| D462,582 | S | 9/2002 | Parlowski | D7/649 |
| D466,422 | S | 12/2002 | Luquire | D10/62 |
| 6,487,948 | B1 | 12/2002 | Alfi | 83/13 |
| 6,553,671 | B1 | 4/2003 | Blanchard | 30/161 |
| 6,560,877 | B1 | 5/2003 | Sanelli | 30/340 |
| 6,591,504 | B1 | 7/2003 | Onion | 30/160 |
| 6,651,344 | B1 | 11/2003 | Cheng | 30/159 |
| 6,684,510 | B1 | 2/2004 | Collins | 30/161 |
| 6,751,868 | B1 | 6/2004 | Glesser | 30/161 |
| 6,834,432 | B1 | 12/2004 | Taylor, Jr. | 30/161 |
| 6,941,661 | B1 * | 9/2005 | Frazer | 30/160 |
| 2003/0070299 | A1 | 4/2003 | Frazer | 30/161 |
| 2004/0134075 | A1 | 7/2004 | Chu | 30/161 |
| 2004/0158991 | A1 | 8/2004 | Freeman | 30/161 |

FOREIGN PATENT DOCUMENTS

| | | |
|---|---|---|
| EP | 0 230 000 | 7/1987 |
| EP | 0 396 938 | 11/1990 |
| FR | 493 741 | 8/1919 |
| FR | 1 171 740 | 1/1959 |
| FR | 1 248 117 | 10/1960 |
| FR | 2 705 606 | 12/1994 |
| JP | 4-030979 | 2/1992 |
| JP | 5-185381 | 7/1993 |
| JP | 9-277202 | 10/1997 |

* cited by examiner

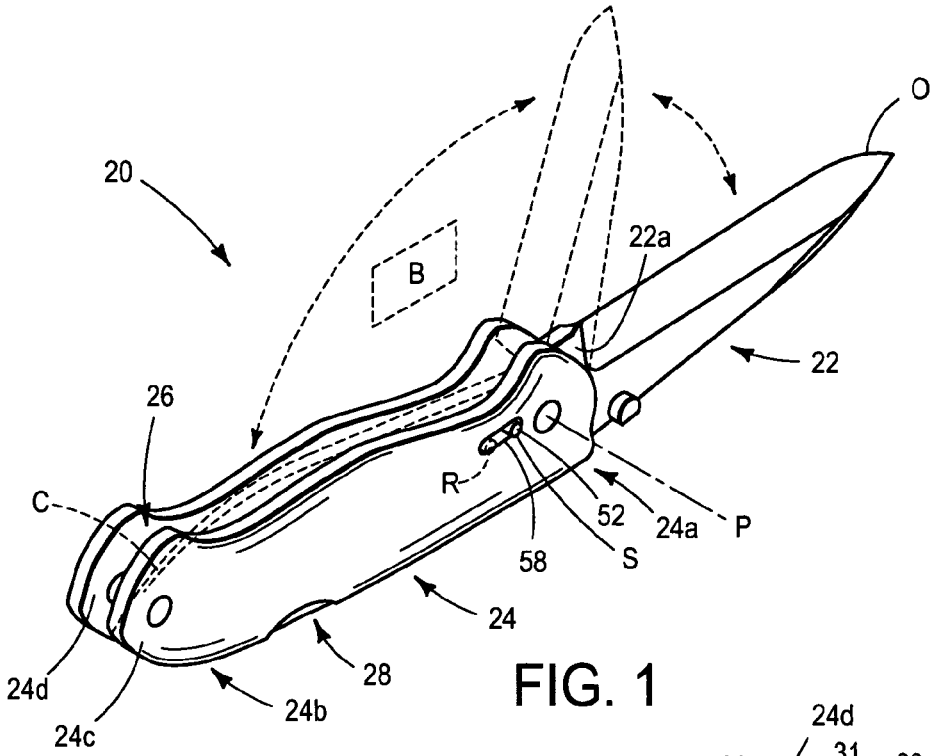
FIG. 1
FIG. 2
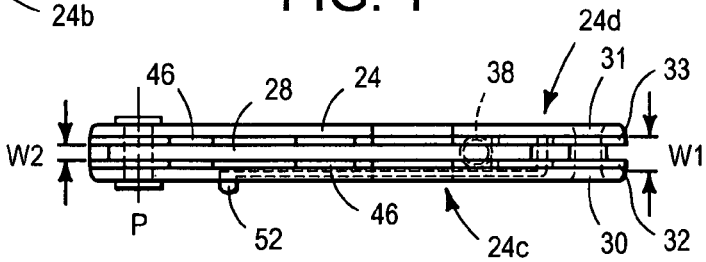
FIG. 3
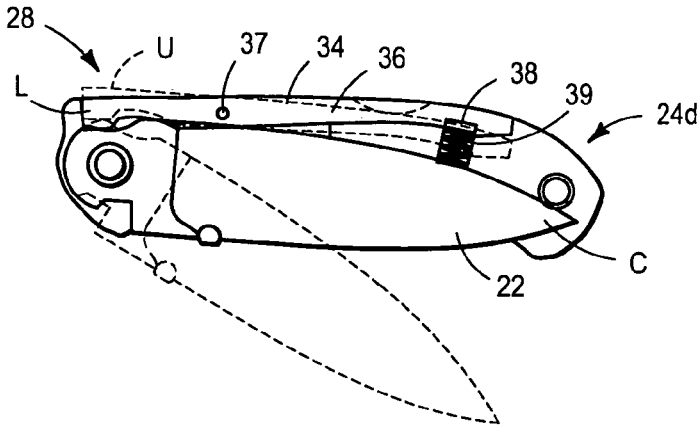
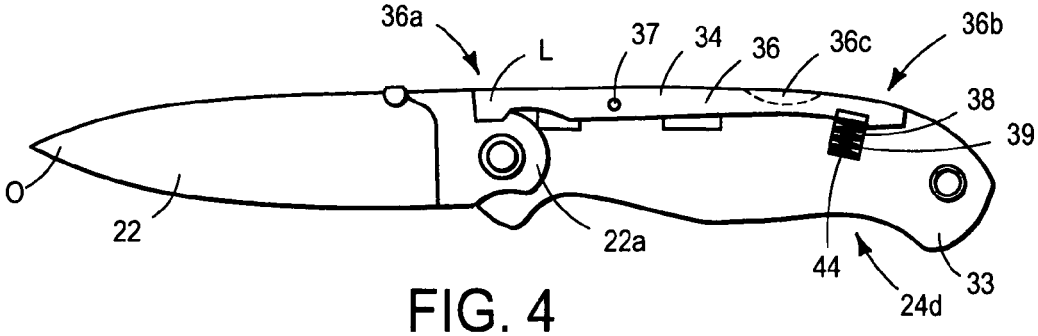
FIG. 4

FOLDING KNIFE HAVING A LOCKING MECHANISM

CROSS-REFERENCE TO RELATED APPLICATIONS

This application claims priority under 35 U.S.C. 119(e) to U.S. Provisional Patent Application Ser. No. 60/475,480 entitled "Folding Knife Spring Improvement and Safety Mechanism," filed Jun. 4, 2003, the entire disclosure of which is herein incorporated by reference.

TECHNICAL FIELD

The present disclosure relates generally to a folding knife, and particularly to a folding knife with a locking mechanism that locks the blade in an open and/or closed position.

BACKGROUND

Folding knives enjoy wide popularity, particularly among sportsmen, campers, hikers, and many others engaged in outdoor activities. Common elements to folding knives include a handle and a blade pivotally connected to an end of the handle so that the blade pivots with respect to the handle between an open position in which the blade is extended away from the handle and a closed position in which the blade is at least partially received within the handle. Many folding knives also include a locking mechanism to maintain the blade in an open and/or closed position.

Examples of folding knives, including folding knives with locking mechanisms, may be found in U.S. Pat. Nos. 1,454,665; 1,743,022; 4,040,081; 4,173,068; 4,404,748; 4,451,982; 4,502,221; 4,719,700; 4,805,303; 4,811,486; 4,837,932; 4,893,409; 4,974,323; 4,979,301; 5,044,079; 5,060,379; 5,095,624; 5,111,581; 5,293,690; 5,325,588; 5,331,741; 5,425,175; 5,502,895; 5,515,610; 5,537,750; 5,546,662; 5,596,808; 5,615,484; 5,685,079; 5,689,885; 5,692,304; 5,737,841; 5,755,035; 5,802,722; 5,822,866; 5,826,340; 5,887,347; 5,964,036; 6,079,106; 6,154,965; 6,338,431; 6,378,214; 6,427,335; 6,438,848; 6,490,797; D348,599, and D373,296; and U.S. Patent Application Nos. 2002/0157260 and 2003/0070299, the entire disclosures of which are herein incorporated by reference for all purposes.

Simple locking mechanisms for locking and/or unlocking the blade of a folding knife may enhance the utility of the knife.

SUMMARY

One embodiment provides a folding knife. The knife includes a handle; a blade having a tang pivotably connected to the handle allowing pivoting of the blade between a closed position in which the blade extends along the handle, and an open position in which the blade extends away from the handle; a locking element pivotably connected to the handle, wherein the locking element is configured to be pivotable between a first position in which the locking element engages at least part of the tang in a manner preventing pivoting of the blade from the open position to the closed position, and a second position in which the blade is free to pivot from the open position to the closed position; a bias element configured to urge the locking element towards the first position; and a safety assembly mounted for sliding movement along the handle, wherein the safety assembly is movable between a safety position in which the safety assembly engages part of the locking element in a manner preventing pivoting of the locking element relative to the handle, and a release position in which the locking element is free to pivot relative to the handle.

BRIEF DESCRIPTION OF THE DRAWINGS

FIG. 1 is an isometric view of a folding knife incorporating a locking mechanism.

FIG. 2 is a rear plan view of the knife of FIG. 1, showing the locking mechanism within the handle.

FIG. 3 is a side view of the knife of FIG. 1, shown without a handle side to show the locking mechanism when the blade is in the closed position.

FIG. 4 is a side view of the knife of FIG. 1, shown without a handle side to show the locking mechanism when the blade is in the open position.

DETAILED DESCRIPTION

Figure 5:
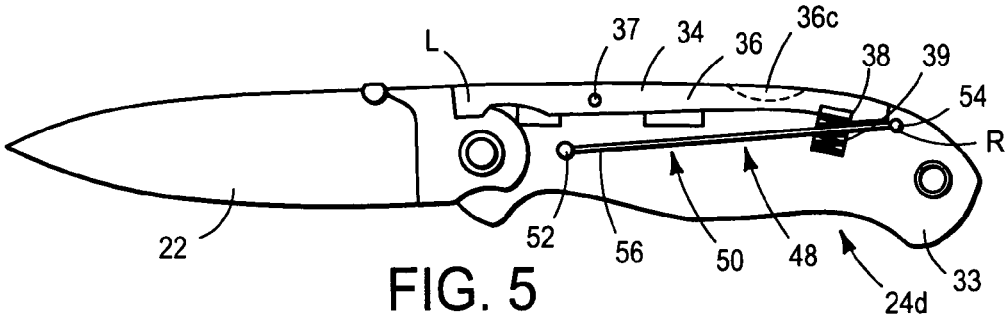
FIG. 5 is a side view of the knife of FIG. 1, shown without a handle side to show a safety mechanism in the release position and the blade in the open position.
Figure 6:
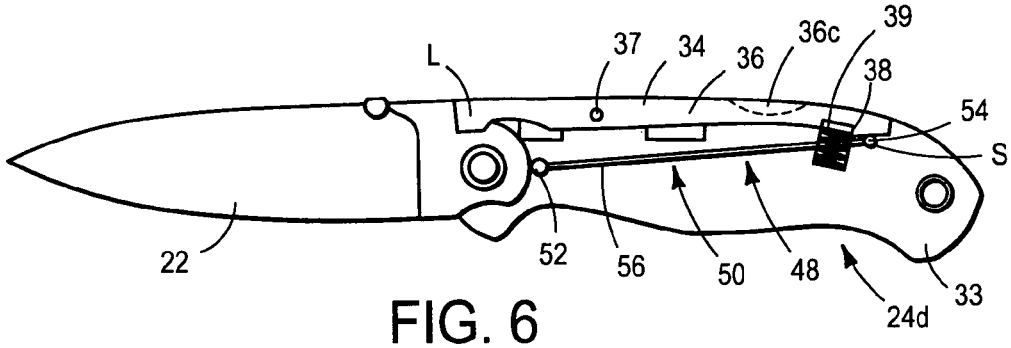
FIG. 6 is a side view of the knife of FIG. 1, shown without a handle side to show the safety mechanism in the safety position and the blade in the open position.

FIGS. 1–2 depict an embodiment of a folding knife 20 having a blade 22, a handle 24 defining a blade-receiving channel 26, and a locking mechanism 28. Blade 22 includes a tang 22*a* pivotally connected to handle 24. Tang 22*a* may be shaped in any suitable way to interact with locking mechanism 28. The blade pivots with respect to the handle about a pivot axis P between an open position O and a closed position C. In the open position, the blade extends away from the handle, where it is deployed and ready for use. From the open position, the blade may be folded towards the handle, pivoting about axis P, into the closed position, in which the blade may be at least partially received for storage within blade-receiving channel 26. In the closed position, blade 22 extends along handle 24. Rotation of blade 22 between open position O and closed position C may define a blade rotation plane B, as shown in FIG. 1.

Handle 24 may include a pivot-end portion 24*a*, an opposing-end portion 24*b*, and first and second handle sides 24*c* and 24*d*. Tang 22*a* of blade 22 may be pivotally connected to handle 24 at pivot-end portion 24*a*. Handle sides 24*c* and 24*d* also may include respective handle side panels, such as opposite handle side panels 30 and 31. Handle side panels 30 and 31 may include respective pivot-end portions 30*a* and 31*a*, and opposing-end portion 24*b* of handle 24, respectively. Handle side panels 30 and 31 may be any suitable shape configured to facilitate gripping or handling of knife 20, including use of locking mechanism 28.

Additionally, handle 24 may include one or more handle liners, such as liners 32 and 33, which may be located between blade 22 and one or more of handle side panels 30 and 31. Liners 32 and 33 may be any suitable shape and may or may not conform to the shape of handle side panels 30 and 31. The liners also may be configured to accommodate and/or support various components internal to handle 24, as further discussed below. Although the exemplary knife discussed and shown in FIGS. 1–2 includes two handle side panels and two liners, any combination of handle side panels and liners may be used.

Locking mechanism 28 may include a locking element 34, which may be suitably structured to engage tang 22*a* and lock blade 22 in the open position. For example, as shown in FIGS. 3 and 4, the locking element may include a locking bar 36 operatively connected to handle 24. The locking bar may be longitudinally disposed along handle 24 and may include a first end portion 36*a* and a second end portion 36*b*. First end portion 36*a* may be adjacent tang 22*a* to engage the tang, while second end portion 36*b* may be spaced from the tang. The first end portion may include any structure configured to engage tang 22*a* and lock blade 22 in the open position.

Figure 7:
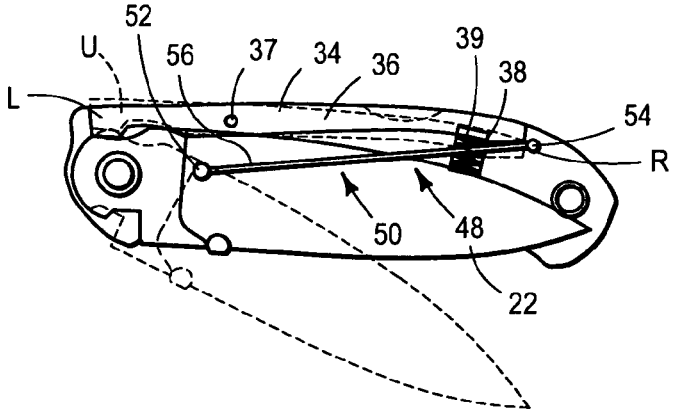
FIG. 7 is a side view of the knife of FIG. 1, shown without a handle side to show the safety mechanism in the release position and the blade in the closed position.
Figure 8:
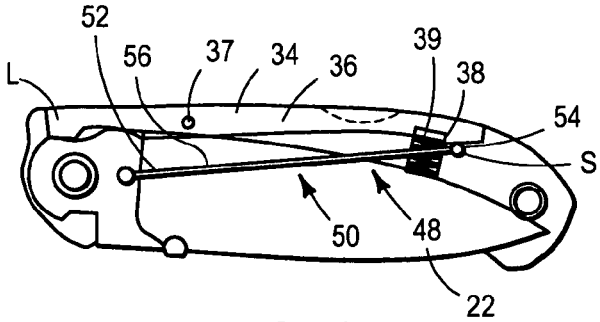
FIG. 8 is a side view of the knife of FIG. 1, shown without a handle side to show the safety mechanism in the safety position and the blade in the closed position.

Locking bar 36 may be mounted for pivoting relative to handle 24. For example, as shown in FIGS. 3 and 7, the locking bar may be pivoted about a pivot 37 between a first or locking position L, where first end portion 36*a* engages tang 22*a* to lock blade 22 in the open position, and a second or unlocking position U, where first end 36*a* is spaced away from tang 22*a* to allow blade 22 to be pivoted from the open position towards the closed position.

Locking bar 36 also may include a manipulable portion 36*c* configured to be manipulated by a user to facilitate pivoting of the locking bar about pivot 37. One or more of handle sides 24*c* and 24*d*, such as handle side panels 30 and 31, and/or liners 32 and 33, may be shaped to expose manipulable portion 36*c*. Alternatively, or additionally, the manipulable portion may be shaped to protrude from the handle side panels and/or liners.

Locking mechanism 28 also may include a bias element 38 configured to urge locking bar 36 towards locking position L. The bias element may be of any suitable size or shape. For example, bias element 38 may be a coiled spring 39 with a width W1 that is wider than the width W2 of channel 26 extending between handle sides 30 and 31 as measured parallel to pivot axis P. Although bias element 36 is depicted in FIGS. 3–4 as a coiled spring 39, it may be of any other suitable type of bias element configured to urge the locking bar towards the locking position, such as wire springs, leaf springs, or other resilient material or structure.

Locking mechanism 28 and blade 22 may be configured to interact in any suitable way to lock blade 22 in the open position. For example, tang 22*a* and first end portion 36*a* of locking bar 36 may be configured such that the locking bar is pivoted from locking position L to unlocking position U (against bias element 38) when blade 22 is pivoted from closed position C towards open position O by action of the blade on the locking bar. Once blade 22 is fully pivoted to the open position, tang 22*a* and first end portion 36*a* may allow the bias element to urge locking bar 36 towards locking position L, thereby allowing the locking bar to lock blade 22 into the open position. When a user desires to pivot blade 22 to the closed position, locking bar 36 may be pivoted into unlocking position U by pushing in manipulable portion 36*c* to counteract bias element 38, thereby allowing the user to freely pivot the blade. Although an exemplary configuration of locking mechanism 28 and blade 22 is discussed and illustrated, any suitable configuration may be used to lock blade 22 in the open position.

Handle 24 may include a support surface 40, which may be any suitable structure configured to support bias element 38. The support surface 40 may be in a support plane that is transverse to the blade rotation plane, or may be in any other suitable plane or shape. In some embodiments, support surface 40 may exist on or extend from only one handle side, may extend from one handle side to another handle side, such as from one liner to another liner, or any suitable combination thereof. The support surface also may be located in any suitable location in handle 24 to enable bias element 38 to urge locking bar 36 towards locking position L. For example, support surface 40 may be located at or adjacent opposing-end portion 24*b* of handle 24.

Figure 11:
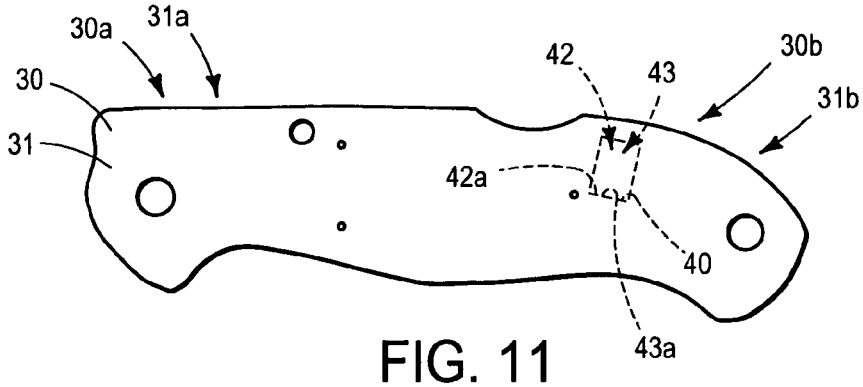
FIG. 11 is a side view of an alternative handle side panel of the knife of FIG. 1.

Further, support surface 40 may be attached to handle side panels 30 and/or 31 or may be formed integral to handle side panels 30 and/or 31. For example, as shown in FIG. 11, support surface 40 may be formed from a cavity 42 on handle side panel 30 and/or a cavity 43 on handle side panel 31. Each cavity may be sized to receive at least a portion of bias element 38 and to provide an edge, such as edge 42*a* or edge 43*a* as the support surface. Where handle 22 has two or more handle sides, each of those handle sides may or may not have a support surface.

Figure 12:
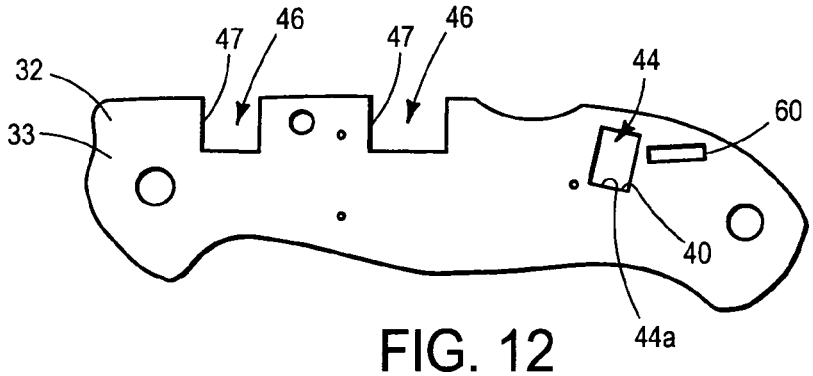
FIG. 12 is a side view of a liner of the knife of FIG. 1.

Alternatively, or additionally, the support surface may be attached to one or both of liners 32 and 33, or may be formed integral to one or both of the liners. For example, as shown in FIG. 12, support surface 40 may be formed from a cavity 44 on liner 32. The cavity may be sized to receive at least a portion of bias element 38 and to provide an edge 44*a* as the support surface. Where handle 22 has two or more liners, each of those liners may or may not have the cavity. In the example shown, both liners have a cavity, and opposite sides of coiled spring 39 extend into the opposed cavities. The edges of the cavity may capture the spring, preventing its movement within blade-receiving channel 26, other than the compression and extension of the spring within the channel, as locking bar 36 pivots about pivot 37. Thus, the cavity edges not only function to support the ends of the spring, but also may limit the range of motion of the spring, and hold it in position adjacent to the end portion of the locking bar.

Although the exemplary locking mechanism is discussed as including a locking bar and bias element, any suitable structure, such as locking latches or hooks, or mechanical, magnetic, or electronic devices, or the like, configured to engage at least part of tang 22*a* of blade 22 to selectively lock blade 22 in the open position may be used.

Figure 13:
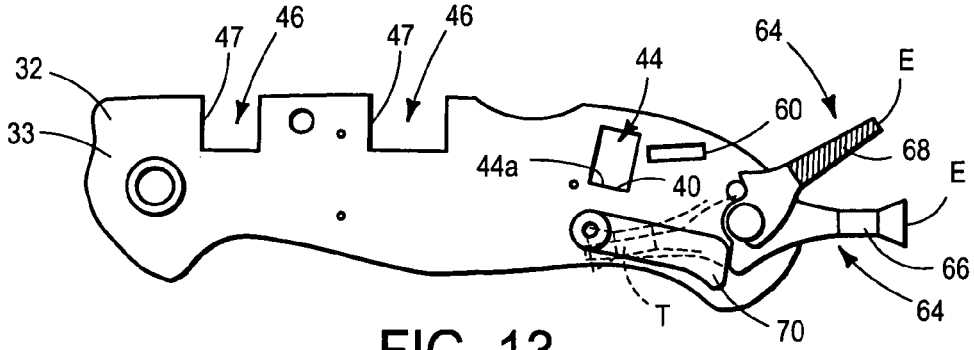
FIG. 13 is a side view of an alternative liner of the knife of FIG. 1 showing tools pivotally connected to the liner with a locking member.

Handle 24 also may include one or more vents, such as vent 46, shaped to facilitate cleaning of components inside handle 24, such as blade 22 and/or locking mechanism 28, as well as channel 26. As shown in FIG. 2, vents 46 may extend between channel 26 and the outside of handle 24, and may be located between locking bar 36 and one or more handle side panels 30 and 31. In this example, the handle side panels are solid, and the vents are formed by one or more notches in the liners, such as notch 47 in the back of handle liner 32, as shown in FIGS. 12 and 13. Although the exemplary knife includes vents 46 arranged between locking bar 36 and handle side panels 30 and 31, vents 46 may be located in any suitable location on handle 24 to facilitate cleaning of components inside handle 24.

Knife 20 also may include a locking safety mechanism 48, which may include any suitable structure configured to prevent a user from unlocking blade 22 from open position O via locking mechanism 28, and/or to prevent a user from pivoting blade 22 from closed position C to open position O. For example, as shown in FIGS. 5–9, safety mechanism 48 may include a safety assembly 50.

Safety assembly 50 may be mounted for movement relative to handle 24. For example, the safety assembly may be slid between a safety position S, where safety assembly 50 prevents locking bar 36 from pivoting from locking position L to unlocking position U, and a release position R, where safety assembly 50 is spaced from locking bar 36 to allow pivoting from locking position L to unlocking position U. Thus, safety assembly 50 may prevent a user from unlocking locking mechanism 28 to pivot blade 22 from the open position towards the closed position. Further, safety assembly also may prevent a user from pivoting blade 22 from the closed position towards the open position by preventing movement of the locking bar from the locking position L, which movement may be required to pivot the blade from the closed position toward the open position.

Figure 9:
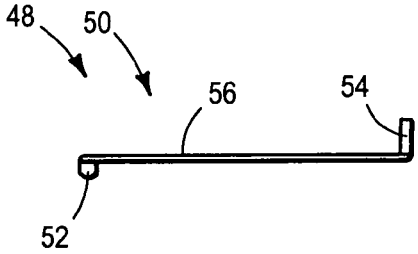
FIG. 9 is a front plan view of the safety mechanism of the knife of FIG. 1.

Safety assembly may include a post 52 connected to a stud 54 via an elongate arm 56, as shown in FIG. 9. Post 52 may be any suitable structure configured to be manipulated by a user to move safety assembly 50 between safety position S and release position R. Stud 54 may be any suitable structure configured to prevent locking bar 36 from pivoting from locking position L to unlocking position U, when the safety assembly is in safety position S. Elongate arm 56 may be any suitable structure configured to connect post 52 and stud 54, such that movement of post 52 translates into movement of stud 54.

Figure 10:
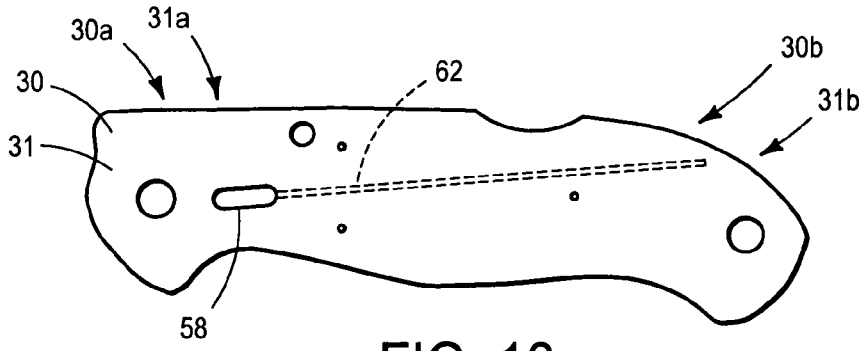
FIG. 10 is a side view of a handle side panel of the knife of FIG. 1.

As shown in FIGS. 10 and 11, handle side panel 30 or 31 and/or liner 32 or 33 may be provided with a post slot 58 configured to allow a user to manipulate post 52 relative to handle 24. In this example, slot 58 may be any suitable size or shape configured to allow post 52 to slide safety assembly 50 between safety position S and release position R. The slot also may be in any suitable location in handle side panel 30 or 31 and/or liner 32 or 33, including adjacent to tang 22*a* of blade 22, as shown.

An appropriate one of handle side panel 30 and 31 and/or liners 32 and 33 also may be provided with a channel 62, which may include any suitable structure configured to support elongate arm 56 of safety assembly 50. Channel 62 may be any suitable shape and size configured to support elongate arm 56 while allowing movement of the elongate arm between the safety and release positions.

Additionally, one or more of handle side panels 30 and 31 and/or liners 32 and 33 may be provided with a stud slot 60 configured to allow stud 54 to selectively interact with locking bar 36. Slot 58 may be any suitable size configured to allow stud 54 to slide in and out of interaction with locking bar 36, as the safety assembly is moved from safety position S to release position R.

Safety assembly 50 may be arranged within handle 24 in any suitable way configured to allow stud 54 to engage locking bar 36 and to allow post 52 to be manipulated by a user outside handle 24. For example, as shown in FIG. 2, safety assembly 50 may be disposed between handle side panel 30 and liner 32, where elongate arm 56 is supported by channel 62 on handle side panel 30, post 52 is disposed within post slot 58 of the handle side protruding out of handle 24, and stud 54 is disposed within stud slot 60 protruding out of liner 32 to interact with locking bar 36. Although an exemplary configuration of safety assembly 50 and handle 24 is discussed, any suitable configuration may be used to prevent a user from unlocking blade 22 from the open position via locking mechanism 28, and/or to prevent a user from pivoting blade 22 from the closed position to the open position.

Although the exemplary safety mechanism 48 discussed includes a post, a stud, and an elongate arm, any other suitable structures, such as pivoting pins or ball bearings, or mechanical, magnetic, or electronic devices, or the like, configured to engage at least part of locking mechanism 28 and selectively prevent unlocking blade 22 from the open position and/or selectively lock blade 22 in the closed position.

Additionally, handle 24 may include one or more tools 64 pivotally connected to handle 24 as shown in FIG. 13. Tools 64 may pivot between a retracted position T, where the tool extends along handle 24, and an extended position E, where the tool extends away from handle 24. Tools 64 may be pivotally connected at any location in handle 24, including opposing-end portion 24*b*. Tools 64 may be connected to handle side panel 30 and/or liner 32, as shown in FIG. 13. Tools 64 may include any suitable tool, including a screwdriver 66 and a file 68.

Handle 24 also may include one or more locking members 70, which may include any suitable structure configured to selectively engage part of one or more tools 64 to prevent pivoting of each tool from the extended position to the retracted position.

Although the folding knives and features of folding knives have been shown and described with reference to the foregoing operational principles and preferred embodiments, those skilled in the art will find apparent that various changes in form and detail may be made without departing from the spirit and scope of the claims. The present disclosure is intended to embrace all such alternatives, modifications, and variances that fall within the scope of the appended claims.

I claim:

1. A folding knife, comprising:

a handle having a tang end and an opposing end portion;

a blade having a tang pivotably connected to the handle at the tang end allowing pivoting of the blade between a closed position in which the blade extends along the handle, and an open position in which the blade extends away from the handle;

a locking element pivotably connected to the handle, wherein the locking element is configured to be pivotable between a first position in which the locking element engages at least part of the tang in a manner preventing pivoting of the blade from the open position to the closed position, and a second position in which the blade is free to pivot from the open position to the closed position;

a bias element configured to urge the locking element towards the first position; and a safety assembly mounted for sliding movement along the handle having a post located at the tang end configured to be manipulable outside the handle and to slide the safety assembly between a safety position and a release position, wherein the safety assembly is moveable between the safety position in which the safety assembly engages part of the locking element in a manner preventing pivoting of the locking element relative to the handle, and the release position in which the locking element is free to pivot relative to the handle.

2. The folding knife of claim 1, wherein the post is received in a slot of the handle.

3. The folding knife of claim 1, wherein the safety assembly includes a stud configured to block pivoting of the locking element when the safety assembly is in the safety position.

4. The folding knife of claim 3, wherein the safety assembly includes an elongate arm connecting the post to the stud.

5. The folding knife of claim 1, wherein the handle includes at least one handle side and a support surface configured to support the bias element.

6. The folding knife of claim 5, wherein the at least one handle side includes a cavity sized to receive at least a portion of the bias element, and the support surface is formed from an edge of the cavity.

7. The folding knife of claim 6, wherein the bias element includes a coiled spring.

8. The folding knife of claim 1, wherein the safety assembly is configured to prevent pivoting of the blade from the closed position towards the open position.

9. The folding knife of claim 8, wherein the at least part of the tang is configured to pivot the locking element from the first position to the second position when the blade is pivoted from the closed position towards the open position.

10. The folding knife of claim 9, wherein the post is received in a slot of the handle.

11. The folding knife of claim 9, wherein the safety assembly includes a stud configured to block pivoting of the locking element when the safety assembly is in the safety position.

12. The folding knife of claim 11, wherein the safety assembly includes an elongate arm connecting the post to the stud.

13. The folding knife of claim 8, wherein the handle includes at least one handle side and a support surface configured to support the bias element.

14. The folding knife of claim 13, wherein the at least one handle side includes a cavity sized to receive at least a portion of the bias element, and the support surface is formed from an edge of the cavity.

15. The folding knife of claim 14, wherein the bias element includes a coiled spring.

16. A folding knife, comprising:

a handle including at least one handle side, a tang end and an opposing end portion;

a blade disposed adjacent to the at least one handle side and having a tang pivotably connected to the handle allowing pivoting of the blade between a closed position in which the blade extends along the handle, and an open position in which the blade extends away from the handle;

a locking element longitudinally disposed along the at least one handle side and pivotably connected to the handle, wherein the locking element is configured to be pivotable between a first position in which the locking element engages at least part of the tang in a manner preventing pivoting of the blade from the open position to the closed position, and a second position in which the blade is free to pivot from the open position to the closed position;

a bias element configured to urge the locking element towards the first position, wherein the handle includes a support surface configured to support the bias element; and a safety assembly mounted for sliding movement along the handle having a post adjacent to the tang of the blade configured to be manipulable outside the handle at the tang end and to slide the safety assembly between a safety position and a release position, a stud configured to block pivoting of the locking element when the safety assembly is in the safety position, and an elongate arm connecting the post to the stud, wherein the safety assembly is moveable between the safety position in which the safety assembly engages part of the locking element in a manner preventing pivoting of the locking element relative to the handle, and the release position in which the locking element is free to pivot relative to the handle.

17. The folding knife of claim 16, wherein the bias element includes a coiled spring.

18. The folding knife of claim 17, wherein the at least one handle side includes a cavity sized to receive at least a portion of the coiled spring, and the support surface is formed from an edge of the cavity.

19. The folding knife of claim 16, wherein the at least one handle side includes at least one liner, and the at least one liner includes at least part of the support surface.

20. The folding knife of claim 19, wherein the at least one liner includes a cavity sized to receive at least a portion of the bias element, and the support surface is formed from an edge of the cavity.

21. The folding knife of claim 20, wherein the bias element includes a coiled spring.

22. The folding knife of claim 16, wherein the support surface is located adjacent to the opposing end portion of the at least one handle side.

23. The folding knife of claim 22, wherein the at least one handle side includes at least one liner, and the at least one liner includes at least part of the support surface.

24. The folding knife of claim 23, wherein the at least one liner includes a cavity sized to receive at least a portion of the bias element, and the support surface is formed from an edge of the cavity.

25. The folding knife of claim 24, wherein the bias element includes a coiled spring.

26. The folding knife of claim 16, wherein the handle includes the locking element and at least one vent configured to facilitate cleaning of components inside the handle.

27. The folding knife of claim 26, wherein the at least one vent is located between the at least one handle side and the locking element.

28. The folding knife of claim 16, further comprising at least one tool pivotally connected to the opposing end portion of the handle, wherein me at least one tool pivots between a retracted position in which the at least one tool extends along the handle, and an extended position in which the at least one tool extends away from the handle.

29. The folding knife of claim 28, further comprising a locking member configured to engage part of the at least one tool in a manner preventing pivoting of the at least one tool from the extended position to the retracted position.

30. The folding knife of claim 28, wherein the at least one tool includes a screwdriver.

31. The folding knife of claim 16, wherein the safety assembly in the safety position prevents the pivoting of the blade from the closed position towards the open position.

32. A folding knife comprising:

a handle including two handle sides, a tang, and an opposing end portion;

a blade disposed between the two handle sides and having a tang pivotably connected to the handle at the tang end allowing pivoting of the blade between a closed position in which the blade extends along the handle, and an open position in which the blade extends away from the handle;

a locking bar longitudinally disposed between the two handles sides and pivotably connected to the handle, wherein the locking bar is configured to be pivotably between a first position in which the locking bar engages at least part of the tang in a manner preventing pivoting of the blade from the open position to the closed position, and a second position in which the blade is free to pivot from the open position to the closed position;

a coiled spring configured to urge the locking bar towards the first position, wherein the handle includes a support surface configured to support the coiled spring; and a safety assembly mounted for sliding movement along the handle having a post located at the tang end configured to be manipulable outside the handle and to slide the safety assembly between a safety position and a release position, a stud configured to block pivoting of the locking element when the safety assembly is in the safety position, and an elongate arm connecting the post to the stud wherein the safety assembly is movable between the safety position in which the safety assembly engages part of the locking bar in a manner preventing pivoting of the locking bar relative to the handle, and the release position in which the locking bar is free to pivot relative to the handle.

33. The folding knife of claim 32, wherein the coiled spring has a first width and the two handle sides defines a channel having a second width measured parallel a pivot axis of the blade, and the first width is greater than the second width.

34. The folding knife of claim 32, wherein the each of the two handle sides includes at least one liner, and wherein the at least one liner includes at least part of the support surface.

35. The folding knife of claim 34, wherein the at least one liner includes a cavity sized to receive at least a portion on the coiled spring, and the support surface is formed from an edge of the cavity.

36. The folding knife of claim 35, wherein the cavity is located adjacent to the second end portion of each of the two handle sides.

37. The folding knife of claim 32, wherein the handle includes the locking bar and at lease one vent configured to facilitate cleaning of components inside the handle.

38. The folding knife of claim 37, wherein the at least one vent is located between at lease one of the two handle sides and the locking bar.

39. The folding knife of claim 32, wherein the handle includes a front portion end portion adjacent to the tang and a second end portion spaced from the tang, and further comprising at least one tool pivotally connected to the opposing end portion of the handle, wherein the at least one tool pivots between a retracted position in which the at least one tool extends along the handle, and an extended position in which the at least one tool extends away from the handle.

40. The folding knife of claim 39, further comprising a locking member configured to engage part of the at least one tool in a manner preventing pivoting of the at least one tool from the extended position to the refracted position.

41. The folding knife of claim 39 wherein the at least one tool includes at least one of a screwdriver and a file.

* * * * *